United States Patent [19]

Murphy et al.

[11] Patent Number: 4,517,206

[45] Date of Patent: May 14, 1985

[54] FOOD PACKAGE AND STORAGE UNIT

[75] Inventors: Gordon D. Murphy, Mahwah, N.J.; Ernest C. Bishop, St. John's, Canada

[73] Assignee: Fishery Products, Inc., Danvers, Mass.

[21] Appl. No.: 549,639

[22] Filed: Nov. 7, 1983

Related U.S. Application Data

[63] Continuation of Ser. No. 378,219, May 14, 1982, abandoned, which is a continuation-in-part of Ser. No. 244,879, Mar. 18, 1981, abandoned, which is a continuation of Ser. No. 76,939, Sep. 19, 1979, abandoned.

[51] Int. Cl.[3] ..... B65D 85/62; B65D 57/00

[52] U.S. Cl. ..... 426/115; 426/119; 426/124; 426/393; 229/87 F; 206/804; 206/526; 206/44.12

[58] Field of Search ..... 53/157; 206/817, 804, 206/526, 44.12; 229/87 F; 220/93

[56] References Cited

U.S. PATENT DOCUMENTS

| | | | |
|---|---|---|---|
| 1,710,386 | 4/1929 | Taylor | 426/108 |
| 1,773,080 | 8/1930 | Birdseye | 426/643 |
| 1,838,000 | 12/1931 | Rumsey | 426/119 |
| 1,988,058 | 1/1935 | Traller | 426/119 |
| 2,114,530 | 4/1938 | Gorton, Jr. | 426/124 |
| 2,509,450 | 5/1950 | Reed et al. | 426/121 |
| 2,533,051 | 12/1950 | Saunders | 426/124 |
| 2,555,033 | 5/1951 | Harris | 426/124 |
| 2,598,373 | 5/1952 | Harry | 426/87 |
| 2,635,965 | 4/1953 | Hensgen et al. | 426/420 |
| 2,665,993 | 1/1954 | Swanson | 426/119 |
| 2,784,103 | 3/1957 | Paxton | 426/128 |
| 2,830,910 | 4/1958 | Swanson | 426/119 |
| 2,888,352 | 5/1959 | Estes | 426/121 |
| 2,920,968 | 1/1960 | Grandy | 426/108 |
| 3,013,886 | 12/1961 | Lowe | 426/115 |
| 3,051,583 | 8/1962 | Tindall | 426/119 |
| 3,051,584 | 8/1962 | Tindall | 426/419 |
| 3,138,466 | 6/1964 | Long | 426/115 |
| 3,152,915 | 10/1964 | Cover et al. | 426/119 |
| 3,261,530 | 7/1966 | Cave | 426/106 |
| 3,326,408 | 6/1967 | Ringlen | 426/106 |
| 3,398,000 | 8/1968 | Peters | 426/119 |
| 3,407,079 | 10/1968 | Griffith et al. | 426/119 |
| 3,530,917 | 9/1970 | Donovan | 426/128 |
| 3,650,383 | 3/1972 | Nigro | 426/124 |
| 3,669,257 | 6/1972 | Janicke | 426/124 |
| 3,671,271 | 6/1972 | Miller | 426/121 |
| 3,730,739 | 5/1973 | Seiferth et al. | 426/119 |
| 3,740,238 | 6/1973 | Graham | 426/128 |
| 3,759,720 | 9/1973 | Young | 426/124 |
| 3,991,168 | 11/1976 | Richards et al. | 426/119 |
| 4,069,348 | 1/1978 | Bush | 426/119 |
| 4,269,316 | 5/1981 | Growney | 426/124 |

FOREIGN PATENT DOCUMENTS

| | | | |
|---|---|---|---|
| 593522 | 2/1934 | Fed. Rep. of Germany | 426/124 |
| 364405 | 10/1962 | Switzerland | 426/124 |

OTHER PUBLICATIONS

Meat, Mar. 1957, p. 114.

*Primary Examiner*—Steven Weinstein

*Attorney, Agent, or Firm*—Thompson, Birch, Gauthier & Samuels

[57] ABSTRACT

A food package and storage unit including a carton, a tray having an opening at the top adapted to be readily slid into and out of one end of the carton and a flexible separator sheet interleaved between thereby to separate food items positioned in the tray. A second sheet extends in a direction transverse to that of the separator sheet to wrap the ends of the food items.

1 Claim, 5 Drawing Figures

FOOD PACKAGE AND STORAGE UNIT

CROSS REFERENCE TO RELATED APPLICATIONS

This application is a continuation of Ser. No. 378,219, filed May 14, 1982, now abandoned; which in turn was a continuation-in-part of Ser. No. 244,879, filed Mar. 18, 1981, now abandoned; which in turn was a continuation of Ser. No. 76,939, filed Sept. 19, 1979, now abandoned.

DESCRIPTION

1. Technical Field

The invention relates to a food package and storage unit providing a capability that one or more portions of food product may be separated with relative ease possibly from a greater number of portions of food product in the food package and storage unit before returning the portion of food product which remain to a storage environment.

2. Background of the Invention

The prior art contains packaging and storage arrangements including a carton serving as an outer package and a tray received in the carton, the tray, in turn, supporting a food item. Typical of this type of arrangement is the package disclosed in U.S. Pat. No. 3,671,271 to H. B. Miller. Packaging and storage arrangements typified by the Miller construction have been found to be unsatisfactory for use in handling food product including a plurality of unit pieces which require separation, reduced air exposure and ease in removal of less than all of the unit pieces of food product prior to returning the food product which remains to a storage environment.

Another example of a prior art packaging and storage arrangement is that disclosed in U.S. Pat. No. 1,773,080 to C. Birdseye. The Birdseye patent, while it proposes the use of a moisture absorbent separation or filler to separate a first and subsequent layer of food product from adjacent layers, fails to provide for ease of removal of one or more portions of food product from the food product which remains, and which is to be returned to the storage environment.

SUMMARY OF THE INVENTION

Broadly, the present invention resides in a food package and storage unit comprising a carton or box providing an enclosure of substantially rigid construction, a tray slidably positionable within the carton, food product including a plurality of individual portions in the tray and a separation medium for separating each individual portion of the food product from an adjacent portion. The separation medium comprises an elongated sheet of a flexible material interleaved in a serpentine fashion among the individual portions of food product. Incremental lengths of the sheet, thus, define sections which separate the individual portions of food product from the inner wall of the carton, from the tray and, as mentioned, from other portions. The unit is especially effective in packaging portions of fish or meat, typically in an amount for individual consumer consumption, in stacked relationship.

It is a feature of the food package and storage unit that upon removal of one or more portions of food product the remaining portions may be stored in the tray. The tray may be used alone or in combination with the carton when the remaining portions of the food product are returned to the storage environment.

It is also a feature of the food package and storage unit that each individual portion is protected against contact with the tray and the inner wall of the carton during transport and storage.

It is a further aspect of the invention in a food package and storage unit to employ an additional separation medium, preferably of a character of the sheet, which likewise is elongated to a length to completely surround the food product along an axis transverse to the axis of the sheet providing interleaved separation.

BEST MODE FOR CARRRYING OUT THE INVENTION

Figure 1:
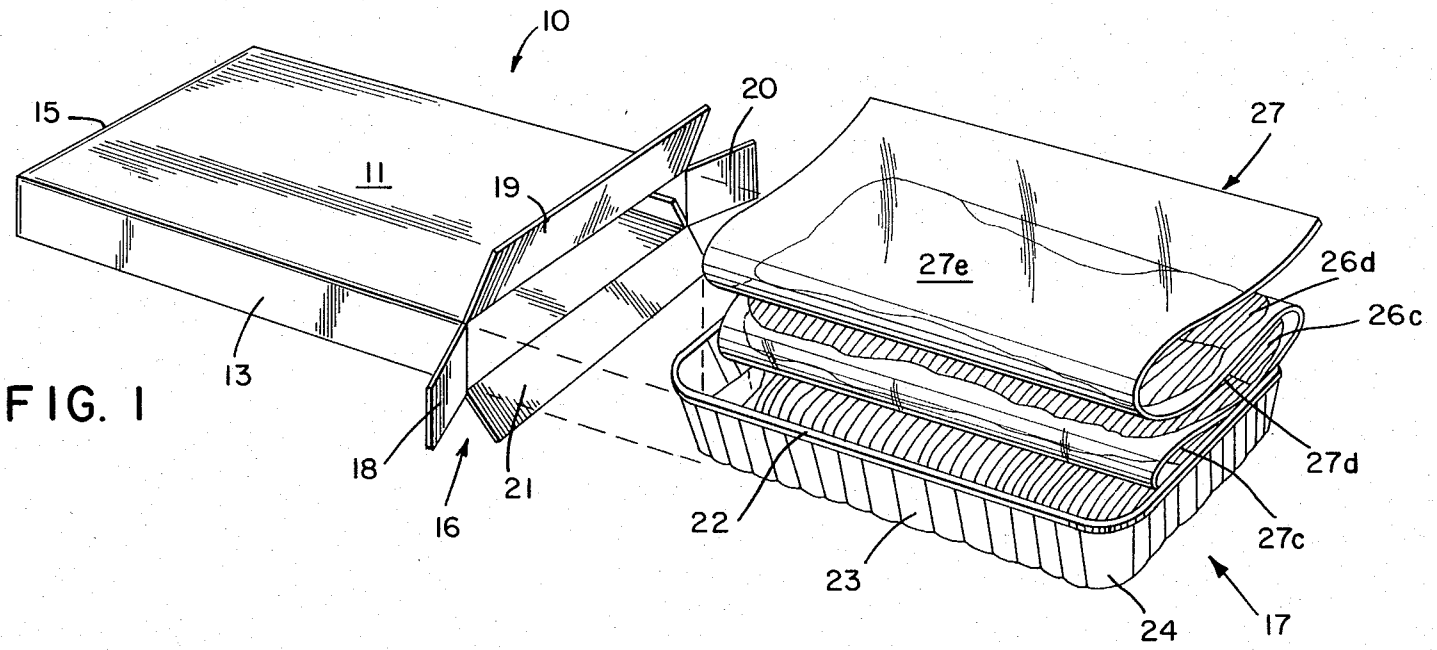
FIG. 1 is a perspective view of the food package and storage unit with the tray withdrawn from the box and both the food items and separator sheet shown in partially exploded view.
Figure 2:
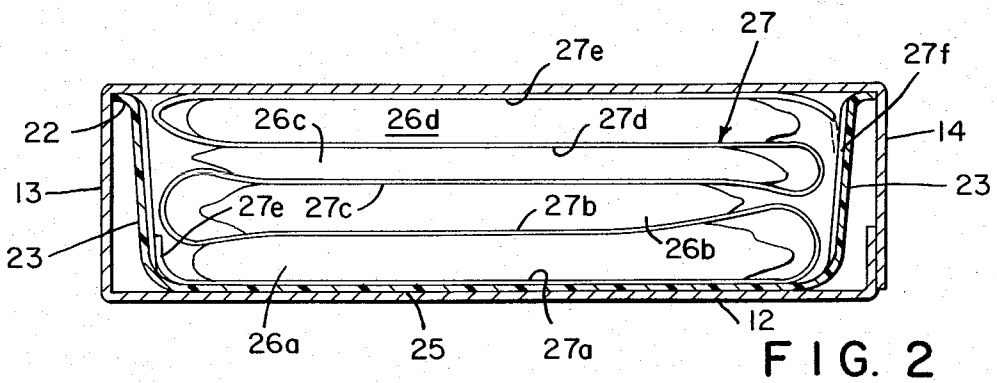
FIG. 2 is a view in section of the assembled unit as seen along a line transverse to the longitudinal axis of the food package and storage unit of FIG. 1.

Referring to FIGS. 1 and 2, a food package and storage unit comprises a carton 10 and a tray 17. The carton may be formed of a paperboard material, or the equivalent, as typically used in the packaging of a food product, and folded to the configuration illustrated including a top panel 11, bottom panel 12, longitudinal side 13, opposite longitudinal side 14, closed end 15 (not totally shown) and a closable end 16, as seen in FIG. 1. The dimensions of the carton are chosen to receive and house tray 17. Preferably, the tray is accommodated within the carton with little or no clearance to prevent movement of the tray relative to the carton during handling. As may be apparent, assembly of the food package and storage unit in the food processing plant is completed upon insertion of tray 17 in carton 10, whereupon flaps 18, 19, 20 and 21 at the closable end are folded shut and suitably sealed together. This confines tray 17, and the carton may undergo subsequent handling without fear of the tray sliding out of the carton.

Tray 17 preferably is formed of a transparent or translucent material, such as plastic thereby to reveal in whole or in part its contents. The tray includes a rim 22, sloping sides and ends 23, each of which extend toward a rounded corner portion 24, and a generally flat bottom 25. The sides and ends provide the tray with sufficient depth to accommodate a plurality of stacked individual portions of food product, as may be seen in FIG. 2. Tray 17 is open at the top and a degree of rigidity is introduced to the tray by the rim and a family of parallel fluted regions along the ends and sides. The tray, thus, is substantially self-supporting when filled with product and held by one hand. Tray 17, also, is preferably fabricated in one piece of impervious material, or if made of a plurality of pieces the pieces are joined so that the tray is capable of holding liquids without leakage.

Referring to FIG. 1, tray 17 is shown with a plurality of food items and a sheet 27 interleaved back and forth over and under individual food items (view of the food items and sheet 27 is partially exploded to show their relationship). Food items may be filets of fish, meat portions or other food portions that are packaged, transported and stored. The food items are illustrated by the identifying indicia 26*a*, 26*b*, 26*c* and 26*d*.

Sheet 27 preferably is one continuous piece of material but may be divided into portions. Each sheet or portion provides sections as it is folded. Sheet 27 is positioned with an end section 27*a* juxtaposed the bottom of tray 17 under food item 26*a*; a second sheet section 27*b* is folded over the top of food item 26*a* to separate food item 26*a* from food item 26*b* packaged above it. Succeeding sheet sections 27*c*, 27*d* and so forth are similarly folded back and forth between stacked food items 26*b*, 26*c*, and 26*d* (see also FIG. 2). Sheet 27 is preferably made of a flexible translucent material which does not adhere unnecessarily to the food item. The material of the sheet, also, should be substantially impervious thereby to aid in prevention of air reaching the food items which results in a drying out of the food items.

As may be seen in FIG. 2, a first end 27*e* of sheet 27 prior to wrapping the food items is disposed along the inner surface of one side of tray 17, at least to the position of the fold of sheet sections 27*b* and 27*c*. The other end 27*f* of sheet 27 is disposed in a similar manner along the inner surface of the other side of the tray, at least to the position of the fold of sheet sections 27*c* and 27*d*. In this manner, each food item 26*a*, 26*b*, . . . 26*n* is located in a pocket including top and bottom sections and a connecting fold formed by the sheet, with the opening to each pocket being substantially closed, for example, by an end 27*e*, juxtaposed folds moving into surface-to-surface contact, and so forth.

Figure 3:
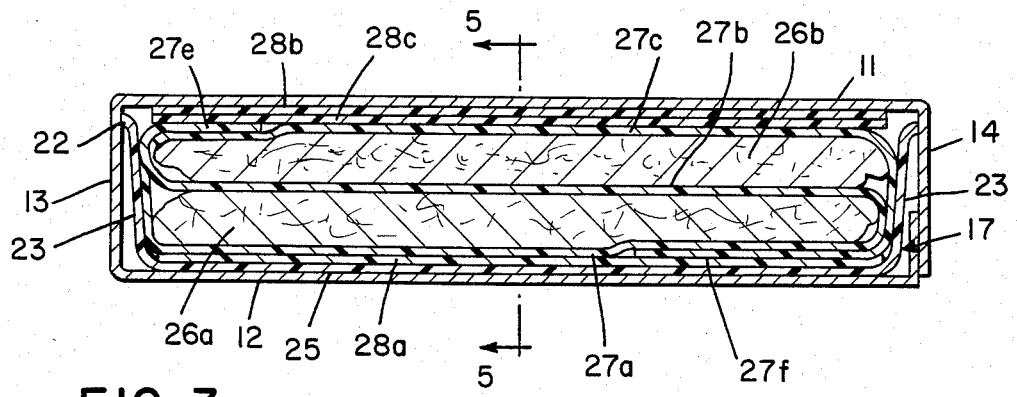
FIG. 3 is a view similar to that of FIG. 2 illustrating another form of the invention.
Figure 4:
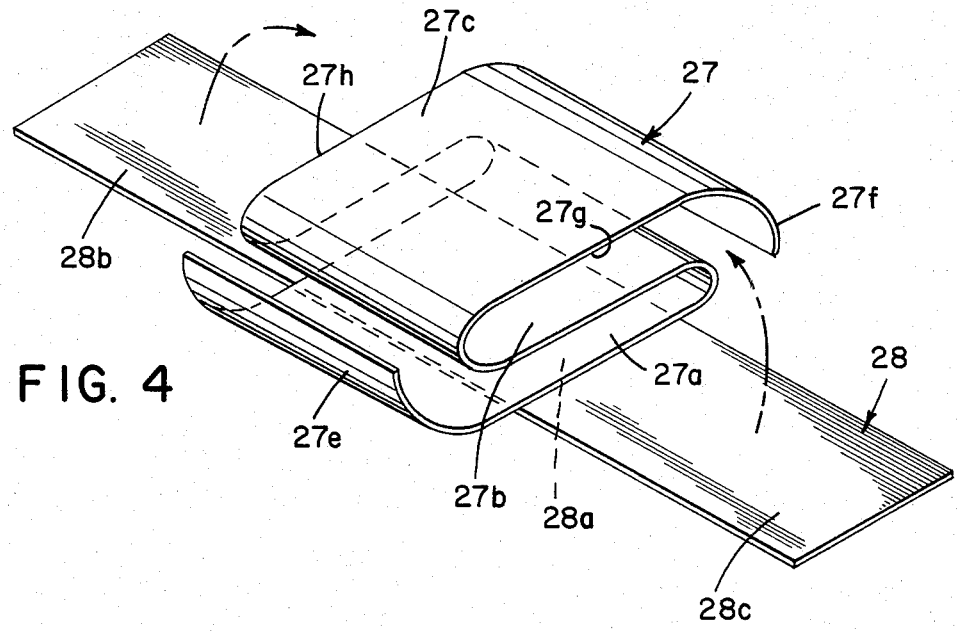
FIG. 4 is a perspective view of a separator sheet and a further sheet of wrapping material used in the form of the invention of FIG. 3.
Figure 5:
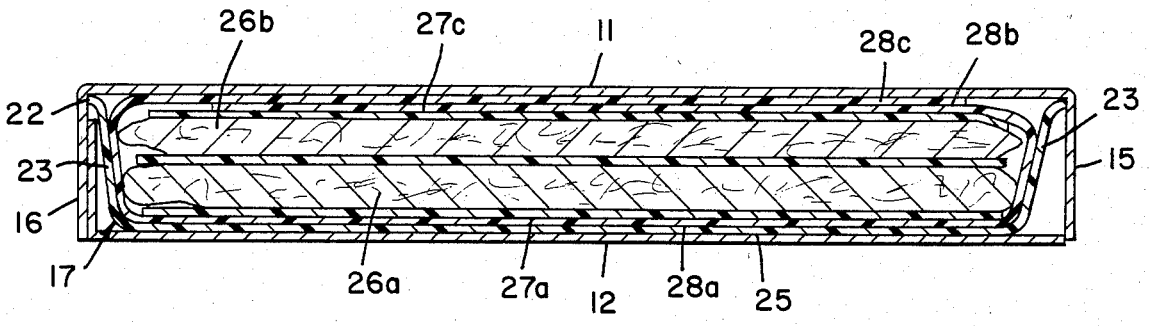
FIG. 5 is a view in section as seen along the line 5—5 in FIG. 3.

Referring to FIGS. 3–5, there is included a second sheet 28 for purposes of providing additional wrap for the ends of the food items which may not have been tightly wrapped by use of sheet 27, above. Sheet 28 is formed of a material like that of sheet 27 and, as may be seen in FIG. 4, is folded along an axis transverse to the axis along which sheet 27 is folded and interleaved.

As may be seen in FIG. 3, the first end 27*e* of the sheet 27 is extended around the fold to a position juxtaposed to the sheet section 27*c* (the top section of a pocket for food item 26*b*) and the other end 27*f* extends around the fold to a position juxtaposed to the sheet section 27*a* (the bottom section of a pocket for food item 26*a*).

The second sheet 28 includes a bottom section 28*a* juxtaposed to the inner surface of the bottom 25 of tray 17 and first and second ends 28*b*, 28*c* juxtaposed one another and juxtaposed top section 27*c*.

As discussed, a food item between sheet sections 27*a* and 27*b* is closed substantially to air by the fold and the first end 27*e*. The food items in each of the other pockets are similarly closed. While the edges 27*g* and 27*h* of the sheet, assuming the sheet is of a width dimension somewhat greater than the length of food item, tend to fold around the ends of the food item in individual pockets, the sheet 28 provides an additional barrier to air.

The package unit of the present invention is particularly useful for food items that are restoraged in either a freezer or refrigerator after first being opened by the consumer. Contents may be removed from tray 17 while the remaining contents can be readily held in the tray alone or in the tray and carton combination as described. The folded sheets 27, 28 help retain freshness of the food items during restorage.

We claim:

1. A frozen fish package and storage unit comprising:

(a) a hollow rectangular carton having a top wall, a bottom wall, two side walls, and two end walls, said carton forming an outer enclosure;

(b) a rectangular tray having a bottom wall, two relatively long side walls, two relatively short end walls, and an open top, said tray being correspondingly sized and shaped to slide into and out of said carton, said tray functioning as a frozen fish storage container separate and apart from said carton, said tray having a continuous rim formed at and running around the upper edges of said tray side walls and tray end walls, said tray having a plurality of spaced-apart flutes formed in said tray side walls and tray end walls, said rim and said flutes causing said tray to be substantially self-supporting;

(c) a first sheet of elongated, continuous, flexible, moisture-impervious, non-stick material having leading and trailing ends and two continuous surfaces, said first sheet trailing end being positioned adjacent one of said tray side walls, said first sheet extending across the width of said tray to a position adjacent the other of said side walls, one surface of said two continuous surfaces of said first sheet being above, downwardly facing, and parallel to the upper surface of said tray bottom wall, a first elongated single serving of frozen fish extending across the width of said first sheet in contact with the other upwardly facing surface of said two continuous surfaces of said first sheet, said first sheet being folded upwardly around and back over said first fish serving, said first sheet extending back across the width of said tray to a position adjacent said one of said tray side walls, said first sheet being wider than the length of said first fish serving thereby forming a food pocket containing said first fish serving, a second elongated single serving of frozen fish extending across the width of said first sheet in contact with said one surface of said first sheet, said second fish serving being spaced vertically apart and separated from said first fish serving by said interleaved first sheet, said first sheet being folded upwardly around and back over said second fish serving, said second sheet extending back across the width of said tray to a position adjacent said other of said tray side walls, said first sheet forming a food pocket containing said second fish serving, said first sheet being successively folded upwardly around and back over one or more additional similar elongated single servings of frozen fish thereby forming one or more additional vertically spaced-apart, open-ended, separated food pockets, each pocket containing a single fish serving, said pocket open ends facing said tray end walls, the longitudinal axes of said pockets being substantially perpendicular to said tray end walls, said first sheet leading end being positioned adjacent one of said tray side walls; and (d) a second sheet of elongated, continuous, flexible, moisture-impervious, non-stick material, said second sheet extending lengthwise of said tray and perpendicular to said first sheet, said second sheet being entirely wrapped around and covering the open pocket ends of said folded first sheet, said second sheet forming a barrier against the entry of air and moisture into the open ends of said food pockets;

(e) said food pockets each containing a single serving of frozen fish in a separate substantially air barrier environment enhancing food freshness and ease of sequential removal of single fish servings from said tray.

* * * * *